US006050399A

United States Patent [19]

Pratt

[11] Patent Number: 6,050,399

[45] **Date of Patent: *Apr. 18, 2000**

[54] PLASTIC CONTAINER CARRIER WITH WIDE SKIRT FOR OBSCURING CONTAINER UPC INDICIA

[75] Inventor: David A. Pratt, Bardstown, Ky.

[73] Assignee: Owens-Illinois Labels Inc., Toledo, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/971,114

[22] Filed: Nov. 14, 1997

[51] Int. Cl.[7] ..... B65D 71/50

[52] U.S. Cl. ..... 206/158; 206/161; 206/459.5

[58] Field of Search ..... 206/147, 151, 206/158, 161, 459.5

[56] References Cited

U.S. PATENT DOCUMENTS

| | | | |
|---|---|---|---|
| D. 294,331 | 2/1988 | Panazzolo . | |
| 3,912,075 | 10/1975 | Berry . | |
| 4,316,538 | 2/1982 | Manizza | 206/158 |
| 4,457,426 | 7/1984 | Humphries | 206/158 |
| 4,460,084 | 7/1984 | Miller . | |
| 4,487,312 | 12/1984 | Heider . | |
| 4,712,680 | 12/1987 | Panazzolo . | |
| 4,872,549 | 10/1989 | Panzzolo | 206/158 |
| 5,492,222 | 2/1996 | Weaver | 206/459.5 |
| 5,657,870 | 8/1997 | Schottle et al. | 206/459.5 |
| 5,682,983 | 11/1997 | Weaver et al. | 206/459.5 |

*Primary Examiner*—Jim Foster

[57] ABSTRACT

A carrier and container assembly that includes a plurality of containers of identical size and geometry, and having identical labels with UPC indicia identically positioned thereon. A carrier of one-piece as-made plastic composition has a top flat wall with openings into which the containers are fastened such that the containers depend from the top wall, and a skirt that extends entirely around the periphery of the top wall and depends therefrom for a distance sufficient at least partially to cover the UPC indicia on the labels of the containers. UPC indicia associated with the carrier and container assembly is externally positioned on the carrier skirt.

6 Claims, 2 Drawing Sheets

PLASTIC CONTAINER CARRIER WITH WIDE SKIRT FOR OBSCURING CONTAINER UPC INDICIA

The present invention is directed to carrier and container assemblies, and more particularly to a carrier and method of use to prevent scanning of UPC indicia on containers affixed to the carrier.

BACKGROUND AND SUMMARY OF THE INVENTION

It has heretofore been proposed in U.S. Pat. Nos. 4,487,312 and 4,712,680 to provide a semi-rigid one-piece carrier of as-made plastic composition having a top wall or panel with a plurality of openings for receiving the necks or finishes of containers to be carried, and a skirt depending from the periphery of the top wall around the shoulders of the containers. Although carriers of such design have enjoyed substantial commercial acceptance and success, further improvements remain desirable. For example, a problem is encountered during purchase of a carrier and container assembly concerning scanning of UPC indicia for automatically identifying price information on the assembly. The individual containers typically have UPC bar code indicia printed on the container labels, for which information is stored concerning the price of the individual filled containers, while UPC indicia associated with the entire container package may be printed or affixed to the carrier. If the indicia on one of the containers is scanned for pricing purposes, the assembly of multiple containers will be grossly underpriced.

It is therefore a general object of the present invention to provide a carrier and container assembly in which UPC indicia on the individual containers is wholly or partially obscured by the carrier so as to prevent reading of the container UPC indicia as relating to the entire container and carrier package. Another object of the present invention is to provide a carrier for use in conjunction with plural containers having UPC indicia disposed at predetermined locations thereon, and a method of using such a carrier, such that the carrier prevents scanning of the container UPC indicia. Another object of the present invention is to provide a carrier for a carrier and container assembly having an extended skirt portion on which UPC indicia associated with the carrier container assembly and/or other advertising declaration may be provided.

A carrier for containers, such as filled beverage containers of predetermined size and configuration having labels thereon at predetermined position, in accordance with a presently preferred embodiment of the invention, includes a one-piece as-made body of plastic composition having a flat top wall portion with a periphery and a plurality of openings for receiving and carrying the necks of the containers. A sidewall portion extends entirely around the periphery of the top wall portion and depends therefrom, having a dimension perpendicular to the top wall portion sufficient to cover at least a portion of the label on a container received in one of the openings. In the preferred embodiment of the invention, the carrier skirt comprises a plurality of first wall portions extending from the top wall portion entirely around the periphery of the top wall portion and contoured to receive the containers. A second wall portion extends from and interconnects the first wall portions, with the second wall portion having a dimension perpendicular to the top wall portion at least twice that of the interconnecting first wall portions.

A carrier and container assembly in accordance with a presently preferred embodiment of the invention thus includes a plurality of containers of identical size and geometry, and having identical labels with UPC indicia identically positioned thereon. A carrier of one-piece as-made plastic composition has a flat top wall with openings into which the containers are fastened such that the containers depend from the top wall, and a skirt that extends entirely around the periphery of the top wall and depends therefrom for a distance sufficient at least partially to cover the UPC indicia on the labels of the containers. UPC indicia associated with the carrier and container assembly is externally positioned on the carrier skirt. A further aspect of the present invention thus contemplates a method of preventing scanner reading of UPC indicia on the individual containers in a carrier and container assembly by dimensioning the skirt of the carrier in a direction perpendicular to the carrier top wall at least partially to cover and obscure the UPC indicia on the container labels when the containers depend from the top wall of the carrier.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
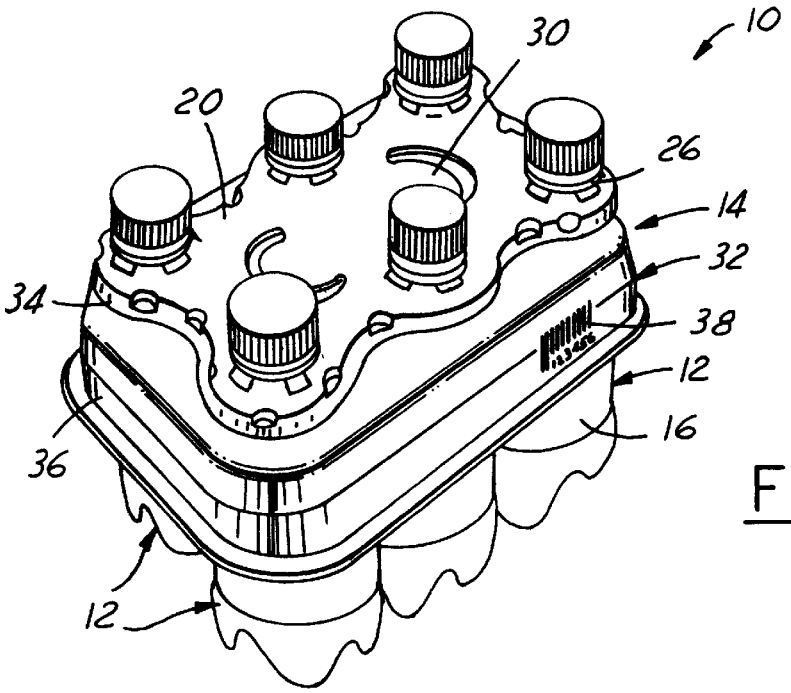
FIG. 1 is a perspective view of a carrier and container assembly in accordance with one presently preferred embodiment of the invention.

FIGS. 1–2 and 4–6 illustrate a carrier and container assembly 10 in accordance with one presently preferred embodiment of the invention as comprising a plurality of filled and capped beverage containers 12 captured by and depending from a carrier 14. Each of the beverage containers 12 has a label 16 affixed thereto, with each label 16 carrying UPC bar code indicia 18 at a predetermined position thereon adjacent to the upper edge of the label. Bar code indicia 18 is assigned in conventional fashion to individual containers depending upon size and beverage type, and may be automatically read or scanned for determining price information associated with the individual containers when sold to a customer.

Figure 4:
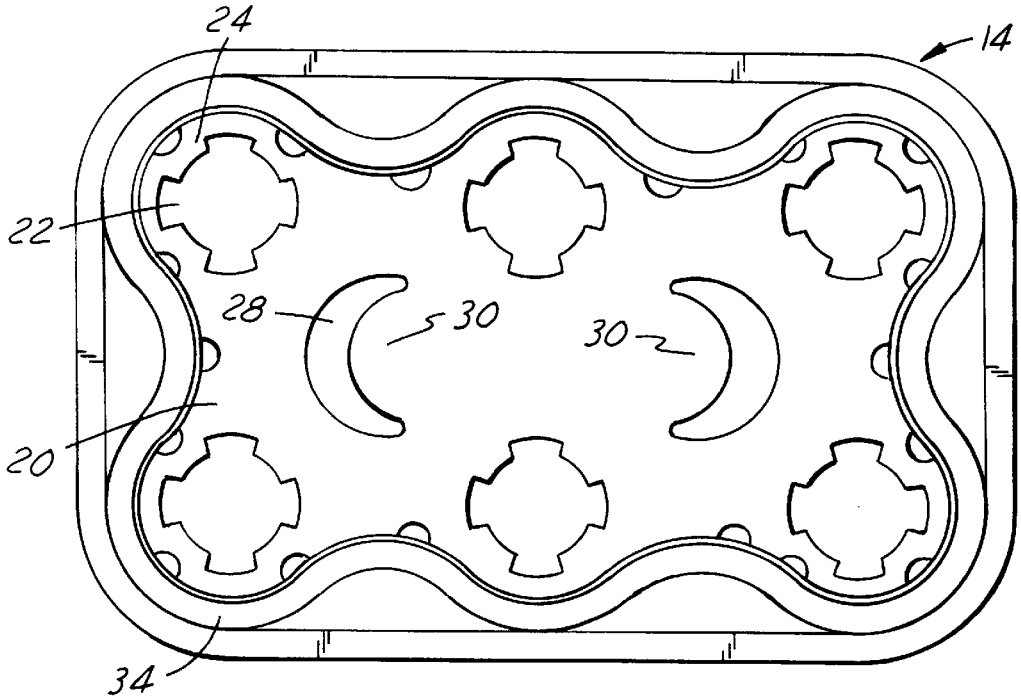
FIG. 4 is a top plan view of the carrier illustrated in FIGS. 1 and 2.
Figure 5:
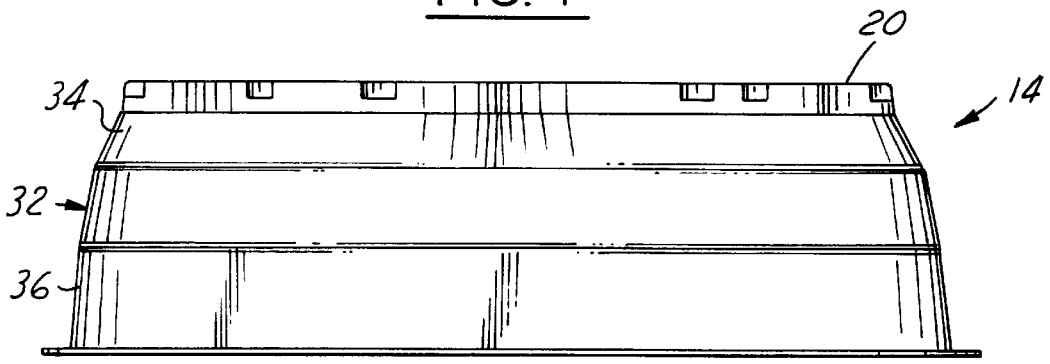
FIG. 5 is a side elevational view of the carrier illustrated in FIG. 4.
Figure 6:
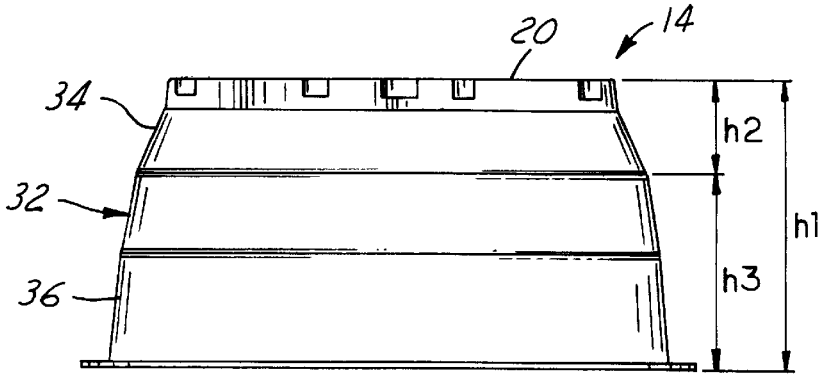
FIG. 6 is an end elevational view of the carrier illustrated in FIGS. 4 and 5.

Carrier 14 is of one-piece as-made semi-rigid plastic composition, having a flat top wall or panel 20 with a plurality of openings 22 for receiving the necks or finishes of the individual containers 12. As shown in FIG. 4, each opening 22 has a plurality of circumferentially spaced radially inwardly extending flexible tabs 24 for resiliently receiving and capturing the necks of the individual containers by engagement with the underside of the neck rings 26 (FIG. 2) of the individual containers. Top panel 20 also has formed therein crescent-shaped openings 28 partially defined by tabs 30 that are resiliently joined to the body of top panel 20 for defining finger openings for carrying the carrier and container assembly. A skirt 32 extends entirely around the periphery of flat top wall 20, and depends therefrom so as to extend around and at least partially enclose the shoulders of containers 12 fastened to the carrier. Skirt 32 is defined by a plurality of first wall portions 34 that are integral with and extend around the periphery of top wall portion 20, and are contoured closely to engage the outer surfaces of the containers 12. A second wall portion 36 extends from the periphery of and interconnects the several first wall portions 34 so as to form a continuous peripheral skirt 32. Carrier 14 may be of high density polyethylene composition, having a thickness of 0.024 inches (24 mils), for example.

In accordance with the present invention, skirt 32 is dimensioned at least partially to cover or obscure, and thereby prevent reader scanning of, bar code indicia 18 on the individual containers 12 carried by carrier 14. Thus, the overall height h1 (FIG. 6) from the flat surface of top panel 20 to the lower edge of skirt 32 is selected in association with the predetermined position of UPC indicia 18 on the labels 16 of containers 12 so as to at least partially cover such indicia. In one presently preferred embodiment of the invention, height h1 has a dimension of at least 2.75 inches. This overall dimensioning of skirt 32 preferably is accomplished by making the height h3 of wall portion 36 equal to at least twice the height h2 of interconnected wall portions 34. Skirt 32 thus at least partially obscures and prevents scanner reading of UPC indicia 18 associated with the individual containers. Second UPC indicia 38 preferably is printed or otherwise provided on skirt portion 36 of skirt 32 associated with a complete carrier and container assembly. Thus, with container indicia 18 at least partially obscured, the scanner operator will be forced to scan indicia 38 when pricing a complete carrier and container assembly. However, when individual containers 16 are removed from the carrier, the same may be scanned and priced by the associated indicia 18.

Figure 3:
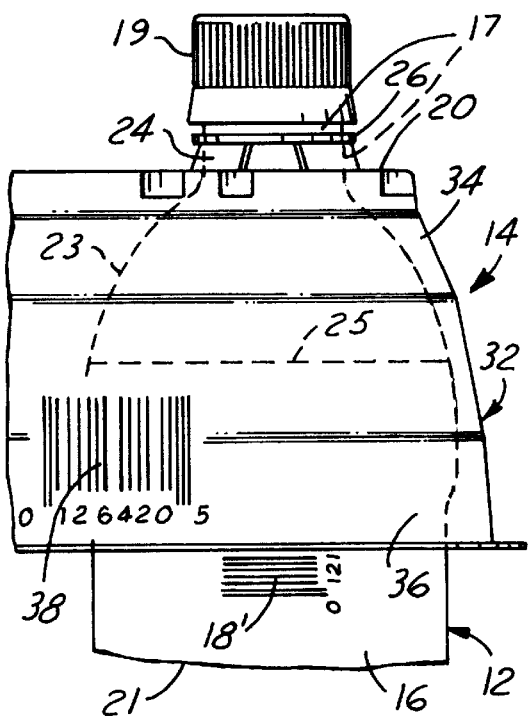
FIG. 3 is a view similar to that of FIG. 2 but showing a modified arrangement in accordance with the invention.

FIG. 3 illustrates a modified embodiment of the invention in which indicia 18 on container label 16 is positioned so as to be only partially obscured by the skirt of carrier 14. In this connection, it is to be noted that indicia 18 need not be completely covered to prevent scanning of the same. Thus, a single carrier configuration 14 may be employed in association with differing filled beverage containers having indicia 18 differently positioned thereon as long as the container indicia 18 is at least partially obscured by the carrier skirt. Furthermore, the extended dimension of carrier skirt 32 provides additional space for imprinting or affixing carrier package indicia 38 and/or other advertising information on the carrier skirt.

Figure 2:
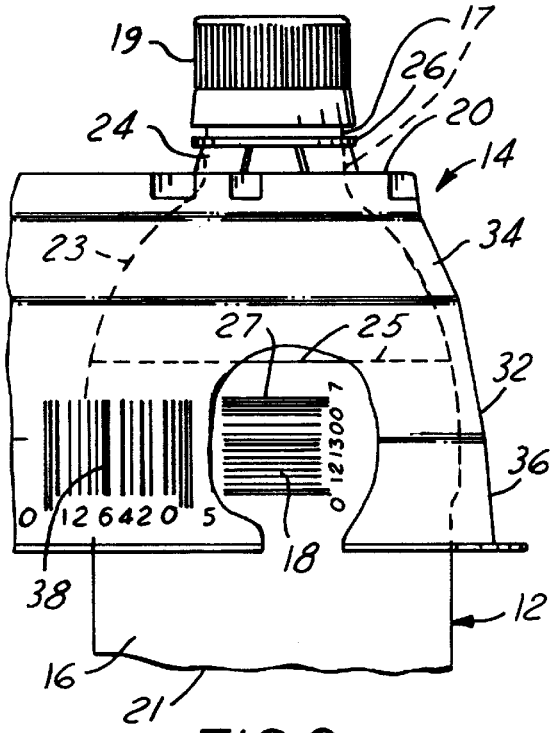
FIG. 2 is a fragmentary view in side elevation of the carrier and container assembly illustrated in FIG. 1.

By way of summary of the foregoing description and appended drawings referenced therein, and as will now be readily understood by those skilled in the art, carrier 14 is adapted for holding, as a package 10, a plurality of containers 12 of identical size and geometry. Each container 12 is of the type having a relatively narrow diameter finish 17 receiving a cap 19 thereon, a main body portion 21 of generally cylindrical exterior contour of substantially greater diameter than the finish diameter, and a taper or shoulder portion 23 that has a downwardly divergent tapering shape, (e.g., convexly curved as shown in phantom in FIGS. 2 and 3). Shoulder portion 23 integrally joins the finish portion 17 to the container main body portion 21 at a lower termination of the curvature of the taper which, as seen in the example of container 12 illustrated in FIGS. 2 and 3, constitutes a maximum outside diameter cylindrical region of container 12. It also will be seen that the cylindrical portion of container main body portion 21 extending axially below shoulder portion 23 is somewhat smaller in outside diameter than such maximum diameter portion. The containers 12 of FIGS. 2 and 3 each have the label 16 thereon respectively bearing UPC bar code indicia 18 (FIG. 2) and 18' (FIG. 3), the bar code indicia preferably being positioned adjacent to the upper edge 25 of label 16. Label 16 in turn is generally positioned on the generally cylindrical labeling area of main body portion 21 and shoulder portion 23 of the container. In the example of FIG. 2, the upper edge 27 of the label UPC bar code indicia 18 is positioned closely below label upper edge 25 and hence generally over the maximum diameter (and generally cylindrical) region of the container taper or shoulder portion 23. However, as shown in the modification of FIG. 3, the label UPC bar code indicia 18' may also be positioned somewhat lower on label 16 so as to be generally over the smaller, consistent diameter cylindrical portion of container body portion 21.

Carrier 14 comprises a one-piece as-made plastic construction having flat top wall 20 provided with finger gripping openings or apertures 28 and container finish-receiving openings 22 adapted for individually receiving the finishes 17 of containers 12 so as to be individually snap-tang fastened beneath the container caps 19. Carrier 14 is thus adapted for hand-carried transport of containers 12 in neck-suspended dependent relation from top wall 20 and arranged as a package 10 of side-by-side containers (FIG. 1) with their maximum diameter portions, i.e., the generally cylindrical lower terminations of their taper or shoulder portions 23 where joined with the smaller diameter cylindrical portions of container body portions 21, in tangential side-by-side contact with mutually adjacent containers, and with the axes of such containers arranged parallel and in rows extending longitudinally and laterally of the package (FIGS. 1, 2 and 3). Carrier 14 has a skirt sidewall portion 32 extending entirely around the periphery of the top wall portion 20 and having an overall height dimension perpendicular to the top wall portion 20 so that skirt sidewall portion 32 is adapted, when in use with the containers 12 for transport as the package 10, to extend downwardly a predetermined distance over the container body portions 21. Skirt sidewall portion 32 of carrier 14 includes a first wall portion 34 extending downwardly from the outer peripheral edge of the top wall portion 20 and of undulating contour and shape adapted to partially surround and embrace the shoulder portion 23 of each of the containers 12 of package 10 to thereby assist in holding the containers in the predetermined array and in side-by-side contact when package 10 is lifted by means of the finger gripping apertures 28 in top wall 20 of the carrier.

Skirt sidewall portion 32 also includes a second wall portion 36 integrally interconnected to the first wall portion 34 and that extends entirely around an outer peripheral lower edge of the first wall portion and downwardly therefrom by a predetermined distance or height dimension. As best seen in FIGS. 1 and 2, second wall portion 36 of skirt 32 is adapted to extend linearly along the sides and ends of the package generally parallel to package side and end planes that are oriented generally tangential to the maximum diameter portion or portions of the array of containers 12 in package 10. The predetermined height dimension of the second wall portion 36, i.e., that dimension perpendicular to the carrier top wall portion 20, preferably is at least about twice that of a like dimension of the first wall portion 34. In any event, it will be seen that such height dimension of the second wall portion 36 insures that its lower edge is positioned downwardly a sufficient distance from the lower edge of the first wall portion 34 such that the second wall portion 36 covers or obscures at least a portion of the UPC indicia 18 or 18' imprinted on those labels 16 (and thereby affixed on the cylindrical portion of shoulder 23 and/or the lesser but constant diameter sidewall portion 21) of any of the package containers 12 that may be oriented with such label indicia 18, 18' facing toward the juxtaposed carrier sidewall second portion 36. Hence, carrier skirt 32 is thereby adapted to function as an obscuring barrier to bar code beam scanning of any such container bar code label indicia that is oriented to face outwardly and thereby be otherwise bar scanner readable but for the beam interference provided by the interposition of the second wall portion 36 of the skirt sidewall portion 32 of carrier 14.

Moreover, it will be seen that, in addition to functioning as a container bar code shield, and due to the predetermined extended depth or height dimension of the vertically downwardly extending second wall portion 36 of carrier 14, the same also covers the exterior facing region of the package array of containers 12 that represent their larger body diameter, i.e. the lowermost portion of the taper or shoulders 23. Second wall portion 36 where so constructed thus advantageously inherently performs the additional "bumper" wall function disclosed in U.S. Berry Patent Ser. No. 3,912,075 (also assigned to the assignee of record herein, Owens-Ill., Inc.), namely, preventing direct container contact with other outside surfaces external to the package.

I claim:

1. A package comprising the combination of a carrier and an associated plurality of containers of identical size and geometry of the type wherein each container has a relatively narrow diameter finish receiving a cap thereon, a main body portion of generally cylindrical exterior contour of substantially greater diameter than the finish diameter, and a shoulder portion integrally joining the finish portion to the upper end of the main body portion and having a generally tapering shape, wherein the containers each have a label thereon bearing UPC bar code indicia and being generally positioned in an upper labeling area of the container with an upper edge of the label UPC bar code indicia being positioned generally adjacent a junction of the container shoulder portion with said container main body portion and in the vacinity of a maximum outside diameter portion of said container, said carrier comprising a one-piece as-made plastic construction having a flat top wall with finger gripping apertures and container finish-receiving openings into which the finishes of the containers are individually snap-tang fastened beneath the container caps such that the containers depend from the top wall and said containers are thereby arranged as a package of side-by-side containers with the maximum outside diameter portions of mutually adjacent containers of said package in tangential side-by-side contact and with the axes of the containers arranged parallel and in rows extending longitudinally and laterally of the package, said carrier having a sidewall portion extending entirely around the periphery of said top wall portion and having an overall height dimension perpendicular to said top wall portion so that said sidewall portion extends downwardly over the container body portions a predetermined distance, said sidewall portion of said carrier comprising a first wall portion extending downwardly from the outer peripheral edge of said top wall portion and of undulating contour shaped to partially surround and embrace the shoulder portion of each of the containers to thereby assist in holding them in said predetermined array and in side-by-side contact when the package is lifted by means of the finger gripping apertures in said top wall of said carrier, said sidewall portion also comprising a second wall portion integrally interconnected to said first wall portion and extending entirely around an outer peripheral lower edge of said first wall portion and extending linearly along the sides and ends of the package generally parallel to package side and end planes generally tangential to the maximum outside diameter portions of the array of containers in the package, said second wall portion having a dimension perpendicular to said carrier top wall portion such that said second wall portion extends downwardly a sufficient distance from said lower edge of said first wall portion such that said second wall portion covers the maximum outside diameter portions of said containers and also covers at least a portion of the UPC indicia on the label affixed on the cylindrical sidewall portion of any package containers oriented with such label UPC indicia facing toward the juxtaposed carrier sidewall second portion, whereby said second wall portion of said carrier sidewall portion functions as a barrier to bar code beam scanning of any such bar code label indicia on said containers in the package that is oriented to face outwardly and thereby be otherwise bar scanner readable but for the beam interference provided by the interposition of said second wall portion of said sidewall portion of said carrier, and wherein said second wall portion has a label thereon with UPC indicia corresponding to the total package embraced by said carrier.

2. The combination as set forth in claim 1 wherein said interconnected first wall portions and said second wall portion have a total dimension perpendicular to the major plane of said top wall of at least two and three-quarter inches.

3. The combination as set forth in claim 1 wherein said second wall portion also has advertising labeling thereon.

4. The combination as set forth in claim 1 wherein said carrier is made of a semi-rigid plastic composition of high density polyethylene having a thickness on the order of 0.024 inches (24 mils).

5. A method of preventing scanner reading of bar code indicia on a package of containers wherein the package comprises the combination of a carrier and an associated plurality of containers of identical size and geometry of the type wherein each container has a relatively narrow diameter finish receiving a cap thereon, a main body portion of generally cylindrical exterior contour of substantially greater diameter than the finish diameter, and a shoulder portion integrally joining the finish portion to the upper end of the main body portion and having a generally tapering shape, wherein the containers each have a label thereon bearing UPC bar code indicia and being generally positioned in an upper labeling area of the container with an upper edge of the label UPC bar code indicia being positioned generally adjacent a junction of the container shoulder portion with the container main body portion and in the vicinity of a maximum outside diameter portion of the container, and wherein said carrier comprises a one-piece as-made plastic construction having a flat top wall with finger gripping apertures and container finish-receiving openings into which the finishes of the containers are individually snap-tang fastened beneath the container caps such that the containers depend from the top wall and said containers are thereby arranged as a package of side-by-side containers with the maximum outside diameter portions of mutually adjacent containers of said package in tangential side-by-side contact and with the axes of the containers arranged parallel and in rows extending longitudinally and laterally of the package, said carrier having a sidewall portion extending entirely around the periphery of said top wall portion and having an overall height dimension perpendicular to said top portion so that said sidewall portion extends downwardly over the container body portions a predetermined distance, said sidewall portion of said carrier comprising a plurality of first wall portions extending downwardly from the outer peripheral edge of said top wall portion and of undulating contour shaped to partially surround and embrace the shoulder portion of each of the containers to thereby assist in holding the package containers in said predetermined array and in side-by-side contact when the package is lifted by means of the finger gripping apertures in said top wall of said carrier, said sidewall portion also comprising a second wall portion integrally interconnected to the outer peripheral lower edge of the first wall portion and extending linearly along the sides and ends of the package generally parallel to package side and end planes generally tangential to the maximum outside diameter portions of the array of containers in the package;

said method of preventing scanner reading of said UPC indicia on said containers as assembled in said package comprising the steps of:

(a) dimensioning said second wall portion in a direction perpendicular to said carrier top wall portion a distance correlated with the position of the container label bar code indicia relative to the carrier top wall portion such that said second wall portion covers the portions of the container having the maximum outside diameter and also covers at least a portion of the UPC indicia on the label affixed on the cylindrical sidewall portion of any of the package containers oriented with such UPC label facing toward a closest portion of said carrier sidewall second portion, whereby said second wall portion of said carrier sidewall portion functions as a barrier to bar code beam scanning of any such UPC bar code label indicia on the containers in the package that is oriented to face outwardly and thereby be otherwise bar scanner readable but for the beam interference provided by the interposition of said second wall portion of said sidewall portion of said carrier, and (b) providing on said carrier a label with UPC indicia corresponding to the total package embraced by said carrier.

6. A package comprising the combination of a carrier and an associated plurality of containers of identical size and geometry of the type wherein each container has a relatively narrow diameter finish receiving a cap thereon, a main body portion of generally cylindrical exterior contour of substantially greater diameter than the finish diameter, and a shoulder portion integrally joining the finish portion to the upper end of the main body portion and having a generally tapering shape, wherein the containers each have a label thereon bearing UPC bar code indicia and being generally positioned in an upper labeling area of the container with an upper edge of the label UPC bar code indicia being positioned generally adjacent the junction of the container shoulder portion with said container main body portion and in the vicinity of a maximum outside diameter portion of said container, said carrier comprising a one-piece as-made plastic construction having a flat top wall with finger gripping apertures and container finish-receiving openings into which the finishes of the containers are individually snap-tang fastened beneath the container caps such that the containers depend from the top wall and said containers are thereby arranged as a package of side-by-side containers with the maximum outside diameter portions of mutually adjacent containers of said package in tangential side-by-side contact and with the axes of the containers arranged parallel and in rows extending longitudinally and laterally of the package, said carrier having a sidewall portion extending entirely around the periphery of said top wall portion and having an overall height dimension perpendicular to said top wall portion so that said sidewall portion extends downwardly over the container body portions a predetermined distance, said sidewall portion of said carrier comprising a first wall portion extending downwardly from the outer peripheral edge of said top wall portion and of undulating contour shaped to partially surround and embrace the shoulder portion of each of the containers to thereby assist in holding them in said predetermined array and in side-by-side contact when the package is lifted by means of the finger gripping apertures in said top wall of said carrier, said sidewall portion also comprising a second wall portion integrally interconnected to said first wall portion and extending entirely around an outer peripheral lower edge of said first wall portion and extending linearly along the sides and ends of the package generally parallel to package side and end planes generally tangential to the maximum outside diameter portions of the array of containers in the package, said second wall portion having a dimension perpendicular to said carrier top wall portion such that said second wall portion extends downwardly a sufficient distance from said lower edge of said first wall portion such that said second wall portion covers the maximum outside diameter portions of said containers and also covers at least a portion of the UPC indicia on the label affixed on the cylindrical sidewall portion of any package containers oriented with such label UPC indicia facing toward the juxtaposed carrier sidewall second portion, whereby said second wall portion of said carrier sidewall portion functions as a protective bumper for the package and as a barrier to bar code beam scanning of any such bar code label indicia on said containers in the package that is oriented to face outwardly and thereby be otherwise bar scanner readable but for the beam interference provided by the interposition of said second wall portion of said sidewall portion of said carrier, and wherein at least said second sidewall portion is constructed and arranged to have an interior surface facing the array of containers in the package and spaced outwardly from said imaginary package side and end planes and hence to be spaced outwardly from said bar code label on each and any of the containers regardless of how any such label is circumferentially oriented in relation to the juxtaposed sidewall portion of the carrier, each of said containers in said package thereby having its body portion exterior surface spaced inwardly from said carrier sidewall second portion.

* * * * *